US006922009B2

(12) United States Patent
Plawski et al.

(10) Patent No.: US 6,922,009 B2
(45) Date of Patent: Jul. 26, 2005

(54) ELECTRIC LAMP

(75) Inventors: Wiktor Kazimierz Plawski, Zduska Wola (PL); Dariusz Mrowka, Lodz (PL); Wilhelmus Hubertus Franciscus Winkelmolen, Weert (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/497,341

(22) PCT Filed: Dec. 4, 2002

(86) PCT No.: PCT/IB02/05177

§ 371 (c)(1),
(2), (4) Date: Jun. 1, 2004

(87) PCT Pub. No.: WO03/049144

PCT Pub. Date: Jun. 12, 2003

(65) Prior Publication Data

US 2005/0077809 A1 Apr. 14, 2005

(30) Foreign Application Priority Data

Dec. 4, 2001 (EP) ..... 01204677

(51) Int. Cl.[7] ..... H01J 5/60; H01J 5/48

(52) U.S. Cl. ..... 313/318.01; 313/318.04; 313/318.09; 313/318.12; 439/615

(58) Field of Search ..... 313/318.01, 318.03, 313/318.04, 318.08, 318.09, 318.12, 573, 578, 238, 292; 439/613, 615

(56) References Cited

U.S. PATENT DOCUMENTS

| | | | | | |
|---|---|---|---|---|---|
| 3,534,217 | A | * | 10/1970 | Vause et al. | 313/318.03 |
| 3,775,634 | A | * | 11/1973 | Hasell et al. | 313/318.03 |
| 3,885,185 | A | * | 5/1975 | Tilley | 313/318.03 |
| 4,215,456 | A | * | 8/1980 | Buunk et al. | 445/27 |
| 4,496,874 | A | * | 1/1985 | Sanders et al. | 313/318.09 |
| 5,032,759 | A | * | 7/1991 | Thiry et al. | 313/318.03 |
| 5,744,901 | A | * | 4/1998 | Friederichs et al. | 313/113 |

* cited by examiner

*Primary Examiner*—Ashok Patel

(57) ABSTRACT

The electric lamp comprises a lamp vessel (1) having an end portion (3) which is surrounded by a shell portion (22) of a lamp cap (20) having screw thread. The end portion (3) has transversal indents (6). A plastic coupling member (30) having arms (33) bearing a cam (31) on their inner surface (34) and being undulated at their outer surface (35) is present in the lamp cap (20). The cams (31) are located in a respective indent (6). The shell portion (22) of the lamp cap (20) is screwed onto the coupling member (30). In the electric lamp, the lamp cap (20) is fitted to the lamp vessel (1) by assembling. The current conductors (7, 8) too may be connected to the contacts (21) of the lamp cap (20) by assembling, thus avoiding time and energy-consuming thermal processes.

10 Claims, 3 Drawing Sheets

ELECTRIC LAMP

The invention relates to an electric lamp equipped with:

a blown-glass lamp vessel having an axis and, around said axis, an end portion with an end where the lamp vessel and a stem extending in the lamp vessel are fused together, which end portion has indentations at a distance from the end, which indentations extend transversely to the axis;

an electric element in the lamp vessel, which electric element is connected to current conductors which issue from the lamp vessel to the exterior via the stem;

a lamp cap with electric contacts, a metal shell portion which is undulated so as to form screw thread, and a base portion with at least one of the electric contacts, the shell portion being present around the end portion and the base portion extending transversely to the axis, and the current conductors each being connected to a respective one of the electric contacts; and a coupling member provided with cams in the lamp cap, which cams engage in a respective indentation, and which coupling member is secured to the lamp cap.

An embodiment of such an electric lamp is known from U.S. Pat. No. 4,496,874.

In the known lamp, the coupling member is an open ring of metal strip which largely surrounds the end portion and which is provided with projections which serve as cams that engage in the indentations of the lamp vessel. The open ring has tongues which press against the end of the lamp vessel and which serve to keep the ring fixed in the axial direction during mounting of the lamp cap. The lamp cap is secured to the ring by welding using a laser.

In the case of commercially available lamps having a blown-glass lamp vessel, the lamp cap is customarily secured to the lamp vessel by means of cement. In these lamps, the indentations in the end portion of the lamp vessel serve to make sure that the cement gets a grip on the lamp vessel. Particularly in the case of lamps having an Edison lamp cap, which must be rotated around their axis a number of times to screw the lamp into the lamp holder and make electric contact with said lamp holder, but also in the case of bayonet lamp caps, which only have to be rotated one quarter of a turn, high requirements are imposed on the strength of the cement joint. Also if the lamp must be removed from the holder after a large number of operating hours, the cement must be sufficiently strong to withstand the resistance exerted by the lamp holder during rotation of the lamp.

A drawback of cement, particularly if the lamp has burned at comparatively high temperatures, resides in that it may have become brittle as a result of which the connection between the lamp vessel and the lamp cap may be lost. As a result, the lamp cap may be retained in the lamp holder when the lamp is being removed from the lamp holder. When the loose lamp cap is removed from the lamp holder, there is a risk of electric shocks.

Another drawback of the use of cement to secure the lamp cap resides in that the through-hardening of the cement after the lamp cap has been provided requires much thermal energy and much time. If high-speed production machines are used to manufacture incandescent lamps, the unit for mounting the lamp cap is embodied so as to be a double unit to keep up with the rate of supply of finished lamp vessels.

In spite of the drawbacks involved in the use of cement, and although the cement-free lamp described in the opening paragraph was proposed as long as twenty years ago, and other proposals for cement-free lamps are of a much more recent date, indicating that there is long-felt need for lamps having a lamp cap that is secured in a cement-free manner, the lamp cap of lamps having a blown-glass lamp vessel is still mounted using cement. This can be attributed to drawbacks attached to the cement-free construction described in the opening paragraph and to similar, older constructions.

A first drawback of the known lamp described hereinabove resides in that the metal coupling member locally exerts large forces on the lamp vessel during placing the lamp in or removing the lamp from a lamp holder, which forces may cause fracture of the lamp vessel. Another drawback resides in that the connection between the lamp vessel and the lamp cap is not a rigid connection, and the lamp cap remains movable. Yet another drawback resides in that securing the lamp cap requires the coupling member to be provided with welded joints. As the coupling member is not visible through the lamp cap, and it cannot be observed whether the coupling member actually contacts the lamp cap at the location of a welding operation, there is no certainty as to the effectiveness of the welding operation.

It is an object of the invention to provide an electric lamp of the type described in the opening paragraph, wherein the lamp cap is firmly connected to the lamp vessel without applying cement or a thermal operation, and wherein the risk of fracture of the lamp vessel due to locally exerted forces is effectively counteracted.

In accordance with the invention, this object is achieved in that the coupling member is a plastic synthetic resin body having a central portion transverse to the axis, and arms which are distributed around the axis and extend from the central portion in the axial direction, which each support at an inner surface a respective one of the cams, and which have an undulatory profile at an outer surface, which undulatory profile is in engagement with the screw thread of the lamp cap.

As the coupling member is made of a plastic synthetic resin, it is capable of deformation in the case of a very local contact with the lamp vessel, resulting in a comparatively large contact surface and hence a reduction of local contact pressure. In addition, the synthetic resin enables the coupling member to have cams whose shape largely corresponds to the shape of the indentations, so that they have a large contact surface with said indentations, resulting in a firm coupling between the lamp vessel and the lamp cap.

When the lamp vessel is finished and the lamp cap must be mounted, the coupling member is provided around the end portion by moving it axially towards said end portion and snapping it on to it such that the cams are in the indentations. Next, the lamp cap is screwed down on the coupling member, so that the coupling between the lamp cap and the lamp vessel is brought about without thermal treatment, and the lamp cap is firmly fixed in position. After the current conductors subsequently have been secured to the contacts, the lamp can be put into operation.

In order to secure the lamp cap against relative rotation, the lamp cap may be locally indented, for example in an indentation in the coupling member or between the arms of the coupling member. Alternatively, it is possible to provide the coupling member with tangential teeth, for example, at the location of the cams at its outer surface and to provide tongues, which are pressed inwards, inside the shell portion of the lamp cap, for example, at a distance from its end that is situated near the lamp vessel, which tongues rattle over the teeth when the lamp cap is screwed on, and engage in a respective tooth in the end position of the lamp cap so as to form a snap connection. The demands imposed on the tongues are very small because they only have to catch the lamp cap during the rotatory movement taking place when the lamp is removed from the lamp holder, and they are loaded predominantly in their longitudinal direction in this process. As the coupling member is situated in the immediate vicinity of the tongues, the latter can be short, as a result of which they are strong in the longitudinal direction.

The arms of the coupling member having said undulatory profile can be used to jointly form a, possibly interrupted, helical profile, however, a helical profile is not necessary to be able to screw the lamp cap with its screw thread onto the arms so as to be in engagement therewith.

Although the coupling member may have only two arms with cams, it is favorable for the coupling if the coupling member has at least three arms. In the latter case, these arms are preferably distributed around the axis through angles of 120 degrees. The coupling member may alternatively have four arms which are, for example, distributed around the axis through angles of 90 degrees, or arranged in pairs that lie opposite to each other, such that the arms of each pair include an angle of 60 degrees with respect to the axis. Alternatively, it is also possible that there are six arms which are uniformly distributed around the axis. It is favorable for the lamp vessel to have six indentations which are uniformly distributed around the axis. In this case, in the course of the manufacture of the lamp, after the lamp vessel has been heated near its end portion to the point where softening occurs, the lamp vessel can be indented using, for example, two identical tools and subsequently inflated against said tools by means of a gas so as to form the indentations. As a result, when the coupling member having three, four or six arms, which are mutually positioned as described hereinabove, is provided, said coupling member does not have to be accurately aligned with respect to the lamp vessel in order to automatically find its proper place.

In a favorable embodiment, the central portion of the coupling member is the base portion of the lamp cap. This embodiment has the important advantage that the use of a conventional lamp cap composed of a metal shell portion and a glass base portion which are fused together is precluded. The manufacture of a conventional lamp cap is expensive owing to the use of molten glass and requires more metal than would be necessary for the mechanical strength of the lamp cap, in particular if aluminum is used as the metal. This can be attributed to the fact that the metal is softened by the comparatively high temperature to which the shell portion is exposed during the provision of the base portion of liquid glass, as a result of which the shell portion must be comparatively thick to be sufficiently strong, for example 0.22 mm instead of for example 0.19 mm.

This embodiment enables the shell portion of the lamp cap near the synthetic resin base portion to be indented, for example into a recess, in order to lock the shell against relative rotation.

The embodiment additionally enables a snap connection to be present between the coupling member and the shell portion of the lamp cap, which snap connection locks the shell portion against rotation.

The shell portion of the lamp cap has an end portion on the side remote from the lamp vessel, and the coupling member may have first axially directed, elastic tongues with hooks which embrace said end portion so as to form the snap connection. After it has been mounted, the shell portion of the lamp cap does not have to be deformed in order to preclude rotation. Also processing of said shell portion to form tongues capable of engaging with teeth of the coupling member is thus precluded.

In a modification, the central portion of the coupling member has an axially directed meandering wall in folds of which the first axially directed elastic tongues are arranged. In different parts of the world, lamp holders of very different construction are used which are all intended however to accommodate a lamp cap of the same shape and size. Among them are lamp holders having a contact member intended to electrically contact the shell portion of the lamp cap, which contact member is arranged on the bottom of the lamp holder. During mounting the lamp in accordance with the invention in, or removing it from, such a lamp holder, such a contact member could be caught by an elastic tongue and annihilate the grip of the tongue's hook on the shell portion. In the modification described herein, this risk is counteracted.

In an attractive modification of the embodiment wherein the central portion of the coupling member is the base portion of the lamp cap, the central portion of the coupling member has a seating for a metal bus which serves as the electric contact.

In this modification, the electric contact can be provided after the manufacture of the coupling member, and it is not necessary to load the mold wherein the coupling member is formed with the contact member before said mold is filled with synthetic resin. The use of a metal bus as the electric contact is attractive because it can be firmly anchored in the synthetic resin. For this purpose, a slit may be present in the synthetic resin wherein the upright wall of the bus is clamped.

The metal bus of the electric contact may have a flaring edge, and the coupling member may have second, axially directed elastic tongues with hooks that embrace said edge so as to form the snap connection. This construction provides very good retention for the electric contact.

The relevant current conductor may be clamped between the electric contact and the coupling member. For example during placing the electric contact, the current conductor may have been entrained by the electric contact into the seating for the contact, so that the current conductor is clamped in the radial direction by the coupling member and the contact. In the above-mentioned construction having two elastic tongues, a good electric contact can be achieved already if the current conductor extends below the electric contact, over an end face of the coupling member as, in this case, a pulling force is exerted on the electric contact causing it to be held in contact with the coupling member in the axial direction, and the current conductor is clamped, possibly also, in the axial direction.

In a conventional lamp cap, the contact has an opening that connects to a channel in the base portion, through which the relevant current conductor issues to the exterior in order to be soldered around the opening. The opening must be narrow to preclude liquid solder from entering. Due to this, it is difficult to pass the current conductor through the opening when the lamp cap is being threaded on the lamp vessel. In the embodiment of the lamp in accordance with the invention described herein, the base portion may have a large opening through which the current conductor can be passed. This is an important advantage of the embodiment. It is also an important advantage that the current conductor is secured to the contact by assembling, which means in the case of an electric lamp, without welding or soldering.

In a particular embodiment, one of the current conductors is wrapped around at least one of the arms of the coupling member in the direction of the screw thread of the shell portion of the lamp cap and is clamped between said arm and the shell portion of the lamp cap so as to form a contact thereof. Connecting a current conductor to the shell portion of a lamp cap by soldering is difficult and, particularly in the case of an aluminum lamp cap, not very reliable. In the customary production machines, the lamp in the making is positioned such that the axis extends in the vertical direction. To form a soldered joint and the lamp cap, which customarily extends over the upper edge of the shell portion, along the lamp vessel and then issues from the lamp cap to the exterior, solder flux must first be provided on a vertical face and after that solder must be provided. In this process, there is a risk that these liquids flow away from the location where they are needed, so that it is possible that the connection, if any, is insufficient.

In the embodiment of the lamp in accordance with the invention, wherein the coupling member has a seating for the relevant contact, and both current conductors are held in a fixed position by the contacts, it is exclusively through assembly that the lamp is provided with the lamp cap and also with connections between the current conductors and the contacts. Thermal processes have not been used. This leads to a substantial reduction of the production time and a very substantial reduction in energy consumption as compared to the production time and energy consumption involved in the mounting of the lamp cap of conventional lamps. An additional important advantage resides in that solder-free lamps also essentially are lead-free lamps, and that flux and solder vapors are avoided in the production process.

The shell portion of the lamp cap may be made of a copper alloy such as, for example, brass or tombac, although aluminum may alternatively be used. The embodiment of the lamp in accordance with the invention wherein the relevant current conductor is connected to the shell portion by clamping the former, has the additional substantial advantage that aluminum alloys may be used, which have the advantage that they are stronger, but which cannot be used to form soldered joints. For example $AlMg_3$, which is a strong aluminum alloy comprising 3% by weight magnesium, can be used in a thickness of, for example, 0.15 mm, whereas a mechanically comparatively weak alloy comprising more than approximately 1.5% by weight Mg and/or more than 5% by weight Si already is incapable of being soldered. The soldered aluminum lamp caps which are currently commercially used are made of Al 3004 and have the following composition: 0.8–1.3% by weight Mg, 1.3–1.5% by weight Mn, 0.7% by weight Fe, 0.5% by weight Si and 0.2% by weight Cu, and the rest is aluminum.

The metal bus that can be used as a contact at the base portion may be obtained from the waste material that results from the manufacture of the shell portion from metal band at the location where the base portion must be provided.

The electric lamp in accordance with the invention may have an Edison lamp cap or a bayonet lamp cap. In the latter case, the lamp has a second electric contact at the base portion if the lamp is intended for mains-voltage operation. The shell portion of the bayonet lamp cap is undulated so as to form screw thread. This is permissible since, in the case of bayonet lamp caps, only the diameter, the axial length and the location and size of the bayonet pins are standardized, while the shape of the shell portion is not. It is sufficient if the area of the shell portion that connects to the lamp vessel is provided with screw thread.

The electric lamp in accordance with the invention may be, for example, an incandescent lamp, such as an incandescent lamp for general lighting purposes, or a reflector lamp, in which case the electric element is an incandescent body. It is alternatively possible that the electric element is an incandescent body in an inner envelope filled with a halogen-containing gas. It is also possible for the electric element to be an electrode pair in an ionizable gas, whether or not in an inner envelope of, for example, quartz glass.

The lamp vessel may be evacuated or filled with gas. The power consumption of the lamp during operation at the design voltage influences the temperature of the lamp cap. Said temperature may be, for example, 210 degrees Celsius in the case of a gas-filled 100 W incandescent lamp. In the case of a 15 W lamp having an evacuated A60 lamp vessel, i.e. a pear-shaped lamp vessel with a largest diameter transverse to the axis of 60 mm, the temperature of the lamp cap during operation is below approximately 80 degrees Celsius.

The temperature of the lamp cap during operation is important in respect of the choice of the synthetic resin to be used for the coupling member. For a comparatively high temperature use can be made, for example, of Liquid Crystalline Polymer (LCP) filled with for example 30% by weight of, for example, glass fiber, which is commercially available under the name Zenith 6130 from Dupont. Alternatively, filled polybutylene terephtalate (PBTP) may be used. Other synthetic resins that may be used are, for example, polyethylene butylene terephtalate, polyether imide, polyether sulfone, polypropylene oxide, polyphenylene sulfide, polyamide imide, polyimide.

An embodiment of the electric lamp in accordance with the invention is shown in the drawing.

Figure 1:
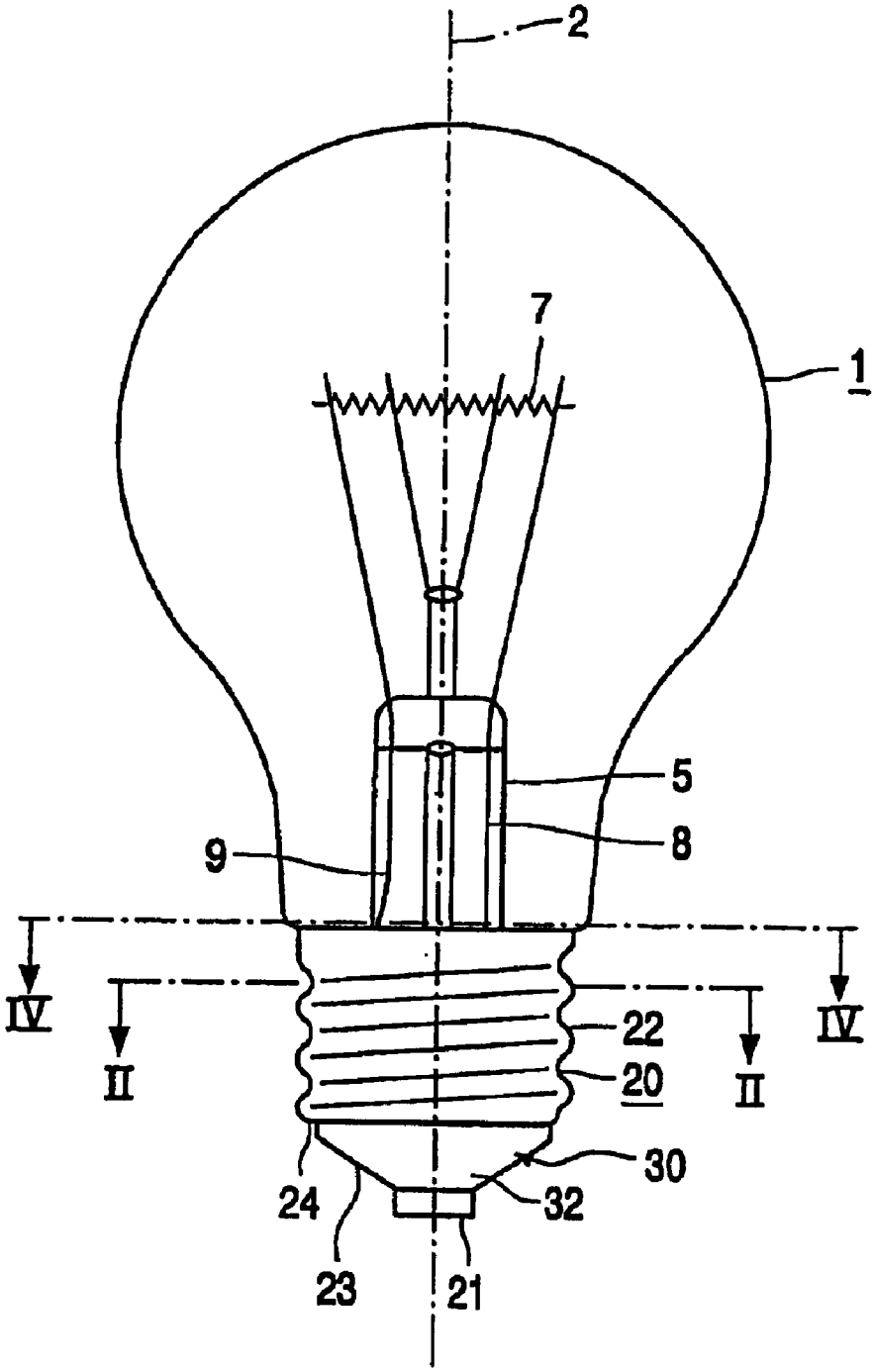
FIG. 1 is a side elevation of a lamp.
Figure 3:
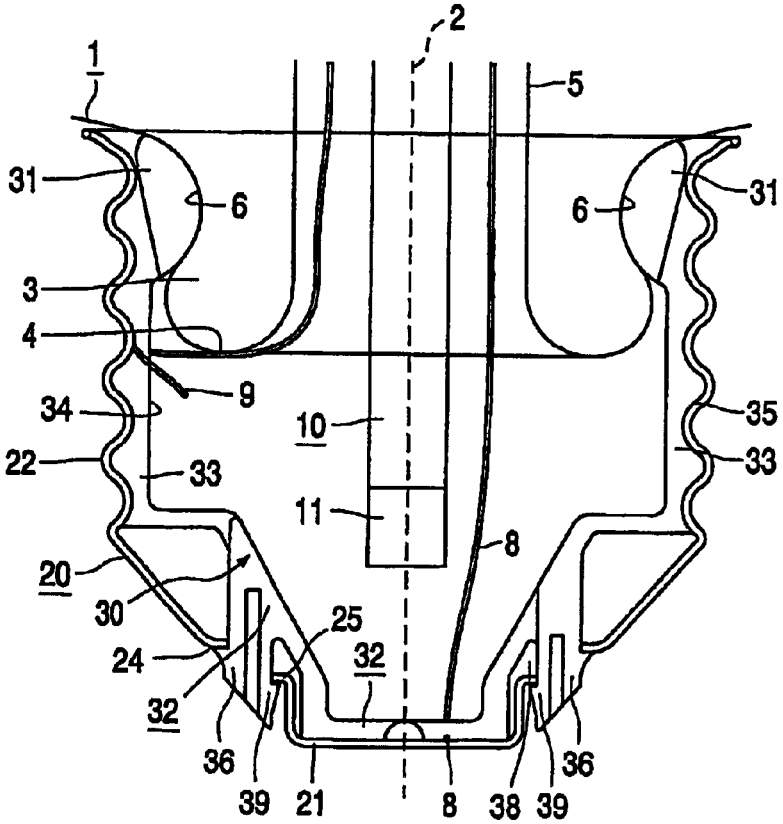
FIG. 3 is a diagrammatic longitudinal sectional view of the lamp cap.

In FIG. 1, the electric lamp is equipped with a blown, glass lamp vessel 1 having an axis 2. Around the axis 2, see FIG. 3, the lamp vessel 1 has an end portion 3 with an end 4 where the lamp vessel 1 and a stem 5 extending in the lamp vessel 1 are fused together. At a distance from the end 4, the end portion 3 has indentations 6 extending transversely to the axis 2. The lamp vessel 1 accommodates an electric element 7, an incandescent body in the Figure, which is connected to current conductors 8, 9 which extend through the stem 5 and issue from the lamp vessel 1 to the exterior. The lamp comprises a lamp cap 20 with electric contacts 21, a metal shell portion 22 which is undulated so as to form screw thread, and a base portion 23 with at least one of the electric contacts 21. The shell portion 22 is present around the end portion 3 and the base portion transverse to the axis 2. The current conductors 8, 9 are each connected with a respective one of the electric contacts 21. In the embodiment shown, wherein the lamp cap 20 is an Edison lamp cap, the shell portion 22 itself is one of the contacts. A coupling member 30, see also FIG. 3, provided with cams 31 is present in the lamp cap 20. Said cams 31 engage in a respective indentation 6. The coupling member 30 is secured to the lamp cap 1.

Figure 4:
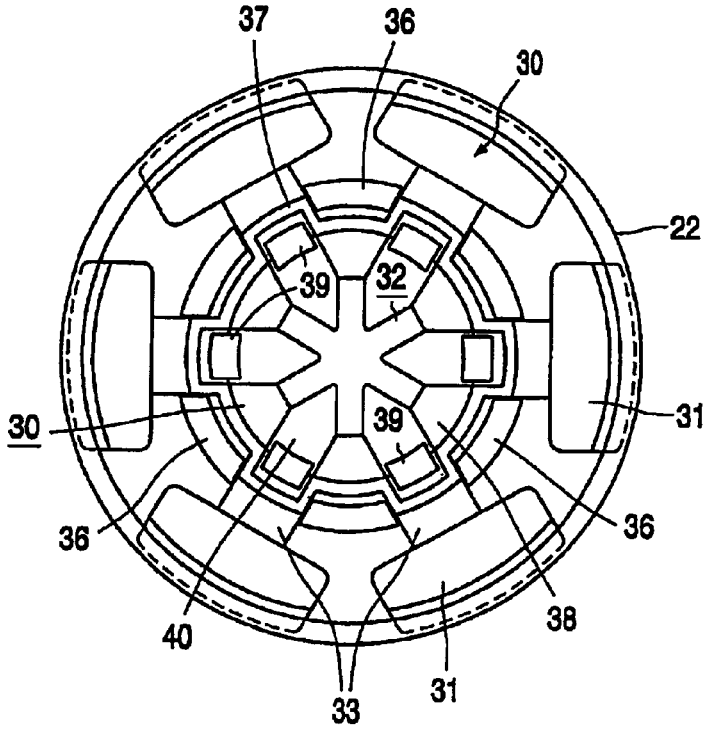
FIG. 4 is a diagrammatic view of the lamp cap taken on the line IV—IV in FIG. 1.
Figure 5:
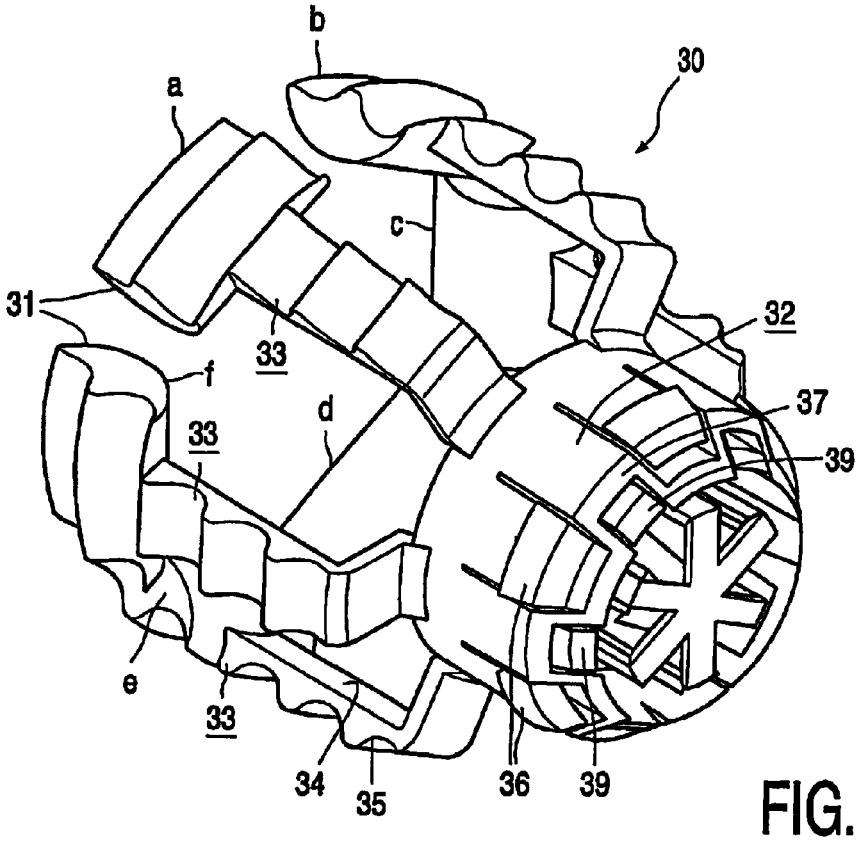
FIG. 5 is a perspective view of an embodiment of the coupling member.

The coupling member 30, see also FIGS. 3, 4 and 5, is a plastic synthetic resin body of Liquid Crystalline Polymer in the embodiment shown, with a central portion 32 transverse to the axis 2, and, distributed around said axis 2, arms 33 extending axially from said central portion 32, which arms each support, on an inner surface 34 thereof, a respective one of the cams 31. At an outer surface 35, the arms 33 are provided with an undulatory profile which is in engagement with the screw thread of the lamp cap 20.

In the embodiment shown, the central portion 32 of the coupling member 30 is the base portion 23 of the lamp cap 20.

In the following Figures, corresponding parts bear the same reference numerals as in FIG. 1.

Figure 2:
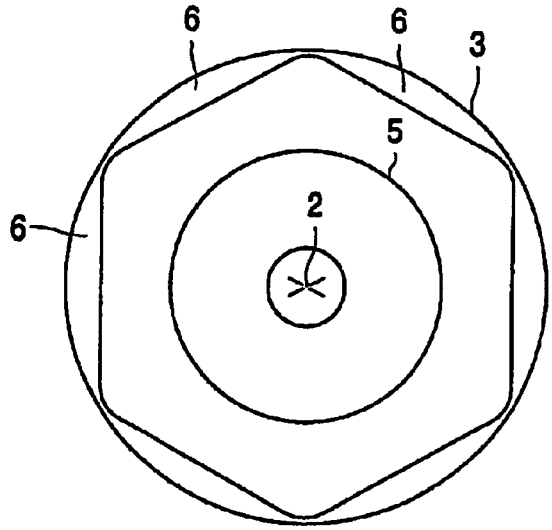
FIG. 2 is a sectional view of the lamp vessel taken on the line II—II in FIG. 1.

FIG. 2 shows that the end portion 3 of the lamp vessel 1 of FIG. 1 has six indentations 6 which are uniformly distributed around the axis 2. The indentations 6 jointly form basically an equilateral hexagon. The coupling member 30, see FIGS. 4 and 5, has at least three arms 33 with a respective cam 31. As shown in FIGS. 4 and 5, the coupling member 30 has six arms, i.e. a through f, see FIG. 5, which jointly surround a regular hexagon. In an alternative embodiment, only the arms a, c and e are present. In a further alternative embodiment, the coupling member 30 only has the arms a, b, d and e. These embodiments have the advantage that a smaller amount of material is needed.

In FIG. 1, a snap connection is present between the coupling member 30 and the shell portion 22 of the lamp cap 20, which snap connection locks the shell portion 22 against rotation.

The shell portion 22 of the lamp cap 20 has an end portion 24 on the side remote from the lamp vessel 1, see FIGS. 1 and 3, and the coupling member 30 has first axially directed elastic tongues 36 with hooks that embrace said end portion 24 so as to form the snap connection. In the embodiment shown, six tongues 36 are present, however, this number may be larger or smaller in alternative embodiments.

The central portion 32 of the coupling member 30 has an axially directed meandering wall 37 in undulations of which the first axially directed elastic tongues 36 are arranged.

The central portion 32 of the coupling member 30 has a seating 38 for a metal bus which serves as the electric contact 21, see FIGS. 3 and 4. The seating 38 is in the form of a comparatively narrow, circular slit.

In FIG. 3, the metal bus of the electric contact 21 has a flaring edge 25. The coupling member 30 of FIGS. 3 and 4 has second, axially directed elastic tongues 39 with hooks which, when the contact 21 is placed in the seating 38, embrace the edge 25 so as to form the snap connection.

To provide the contact 21, the relevant current conductor 8, see FIG. 3, is arranged transversely over the central portion 32 of the coupling member 30 and hence is clamped between the electric contact 21 and the coupling member 30 after the contact 21 has been provided.

One of the current conductors, i.e. 9, is wrapped around at least one of the arms 33 of the coupling member 30, in the direction of the screw thread of the lamp cap 20, and clamped between said arm 33 and the shell portion 22 of the lamp cap 20 so as to form the contact thereof.

The lamp vessel 1, see FIG. 3, accommodates an exhaust tube 10 in the stem 5, which exhaust tube has a sealing 11.

The coupling member 30, see FIGS. 4 and 5, has six large openings 40 in the central portion 32 through which the relevant current conductor 8, see FIG. 3, can readily be passed to the exterior during the assembly of the lamp.

What is claimed is:

1. An electric lamp equipped with:

a blown-glass lamp vessel (1) having an axis (2) and, around said axis (2), an end portion (3) with an end (4) where the lamp vessel (1) and a stem (5) extending in the lamp vessel (1) are fused together, which end portion (3) has indentations (6) at a distance from the end (4), which indentations extend transversely to the axis (2);

an electric element (7) in the lamp vessel (1), which electric element is connected to current conductors (8, 9) which issue from the lamp vessel (1) to the exterior via the stem (5);

a lamp cap (20) with electric contacts (21), a metal shell portion (22) which is undulated so as to form screw thread, and a base portion (23) with at least one of the electric contacts (21), the shell portion (22) being present around the end portion (3) and the base portion extending transversely to the axis (2), and the current conductors (8, 9) each being connected to a respective one of the electric contacts (21);

a coupling member (30) provided with cams (31) in the lamp cap (20), which cams (31) engage in a respective indentation (6), and which coupling member (30) is secured to the lamp cap (20), characterized in that the coupling member (30) is a plastic synthetic resin body having a central portion (32) transverse to the axis (2), and arms (33) which are distributed around the axis (2) and extend from the central portion (32) in the axial direction, which each support at an inner surface (34) a respective one of the cams (31), and which have an undulatory profile at an outer surface (35), which undulatory profile is in engagement with the screw thread of the lamp cap (20).

2. An electric lamp as claimed in claim 1, characterized in that the end portion (3) has six indentations (6) which are uniformly distributed around the axis, and the coupling member (30) has at least three arms (33) with a respective cam (31).

3. An electric lamp as claimed in claim 1, characterized in that the central portion (32) of the coupling member (30) is the base portion (23) of the lamp cap (20).

4. An electric lamp as claimed in claim 1, characterized in that a snap connection is present between the coupling member (30) and the shell portion (22) of the lamp cap (20), which snap connection locks the shell portion (22) against rotation.

5. An electric lamp as claimed in claim 4, characterized in that the shell portion (22) of the lamp cap (20) has an end portion (24) on the side remote from the lamp vessel (1), and the coupling member (30) has first axially directed elastic tongues (36) with hooks which embrace said end portion (24) so as to form the snap connection.

6. An electric lamp as claimed in claim 5, characterized in that the central portion (32) of the coupling member (30) has an axially directed meandering wall (37) in folds of which the first axially directed elastic tongues (36) are arranged.

7. An electric lamp as claimed in claim 3, characterized in that the central portion (32) of the coupling member (30) has a seating (38) for a metal bus which serves as the electric contact (21).

8. An electric lamp as claimed in claim 7, characterized in that the metal bus of the electric contact (21) may have a flaring edge (25), and the coupling member (30) may have second, axially directed elastic tongues (39) with hooks that embrace the edge (25) so as to form the snap connection.

9. An electric lamp as claimed in claim 7, characterized in that the relevant current conductor (8) is clamped between the electric contact (21) and the coupling member (30).

10. An electric lamp as claimed in claim 1, characterized in that one of the current conductors (9) is wrapped around at least one of the arms (33) of the coupling member (30) in the direction of the screw thread of the shell portion (23) of the lamp cap (20) and is clamped between said arm (33) and the shell portion (22) of the lamp cap (20) so as to form a contact thereof.

* * * * *